US005956910A

United States Patent [19]

Sommerstein et al.

[11] Patent Number: 5,956,910

[45] Date of Patent: Sep. 28, 1999

[54] PANEL MOUNTING STRUCTURE

[76] Inventors: Michael Sommerstein, 75 Green Acres Road, Thornhill, Ontario, Canada, L4J 4S2; Barry Mandelzys, 205 Judith Avenue, Thornhill, Ontario, Canada, L4J 7G3

[21] Appl. No.: 08/963,268

[22] Filed: Nov. 3, 1997

[51] Int. Cl.[6] ..... E04B 2/88

[52] U.S. Cl. ..... 52/235; 52/302.1; 52/509; 52/510; 52/512

[58] Field of Search ..... 52/235, 509, 510, 52/512, 385, 302.1

*Primary Examiner*—Carl D. Friedman
*Assistant Examiner*—Laura A. Callo
*Attorney, Agent, or Firm*—Ridout & Maybee

[57] ABSTRACT

A plurality of vertically adjacent panels each has an upper edge portion and a lower edge portion, a support being provided for mounting the upper edge portion of each panel and the lower edge portion of the upwardly adjacent panel. The upper edge portion of the panel has an upstanding flange disposed within a first downwardly open channel of the support with screw members extending through the upstanding flange and into the support to retain the upstanding flange in the first channel, and the lower edge portion of the upwardly adjacent panel has a further upstanding flange disposed within a second downwardly open channel of the support, thereby to mount the upper edge portion of the panel and the lower edge portion of the upwardly adjacent panel on the support.

9 Claims, 6 Drawing Sheets

PANEL MOUNTING STRUCTURE

This invention relates to a panel mounting structure of the type comprising a plurality of vertically adjacent panels removably mounted on supports which are mounted on, for example, a building structure so that the panels constitute a cladding for a building structure, each panel having an upper edge portion and a lower edge portion, with the supports each being provided for mounting the upper edge portion of one of the panels and the lower edge portion of the upwardly adjacent panel. The panel mounting structure permits each panel to be mounted and removed without disturbing the vertically adjacent panels so that, for example, a damaged panel may readily be replaced without the need to disturb panels adjacent to the damaged panel.

Such a panel mounting structure is disclosed in U.S. Pat. No. 5,544,461 to Michael Sommerstein in which the upper edge portion of each panel has a downwardly open hook which is in engagement with an upstanding rib of the support, and the lower edge portion of the upwardly adjacent panel has a further downwardly open hook which is in engagement with a further upstanding rib of the support, thereby to mount the upper edge portion of the panel and the lower edge portion of the upwardly adjacent panel on the support. While in this panel mounting structure of U.S. Pat. No. 5,544,461 the mounting and removal of the panels on and from the supports can be performed without the use of any tools, the provision of the downwardly open hook on the upper edge portion and the further downwardly open hook on the lower edge portion of each panel increases the cost of manufacture of the panels, and it is a primary object of the present invention to provide a panel mounting structure of the type hereinbefore described in which the downwardly open hook on the upper edge portion and the further downwardly open hook on the lower edge portion of each panel are eliminated thereby reducing the cost of manufacture of the panels.

A panel mounting structure according to the present invention comprises a plurality of vertically adjacent panels each having an upper edge portion and a lower edge portion, and supports each of which is for mounting the upper edge portion of one of the panels and the lower edge portion of the upwardly adjacent panel. Each support has a first vertically extending downwardly open channel and a second vertically extending downwardly open channel, said upper edge portion of said one of the panels having a vertically extending upstanding flange which is vertically movable by vertical movement of said one of the panels into and out of the first downwardly open channel of the support without vertical movement of the upwardly adjacent panel, the upstanding flange of the upper edge portion of said one of the panels being detachably securable to the support when disposed in the first downwardly open channel to retain therein the upstanding flange of the upper edge portion of said one of the panels. Said lower edge portion of the upwardly adjacent panel has a vertically extending upstanding flange which is vertically movable by vertical movement of the upwardly adjacent panel into and out of the second downwardly open channel of the support without vertical movement of said one of the panels, and the spacing between the upper edge portion of each panel and the lower edge portion of the upwardly adjacent panel is at least as great as the vertical extent of the upstanding flange of the lower edge portion of the upwardly adjacent panel disposed within the second downwardly open channel of the respective support, and being at least as great as the vertical extent of the upstanding flange of the upper edge portion of the upwardly adjacent panel disposed within the first downwardly open channel of the respective support. There is thereby provided said mounting on the respective support of the upper edge portion of said one of the panels and the lower edge portion of the upwardly adjacent panel, with the upper edge portion and the lower edge portion of each panel being so mountable on and dismountable from the respective supports without disturbing the mounting of the vertically adjacent panels.

In order that the invention may be more clearly understood and more readily carried into effect the same will now, by way of example, be more fully described with reference to the accompanying drawings in which.

Figure 1:
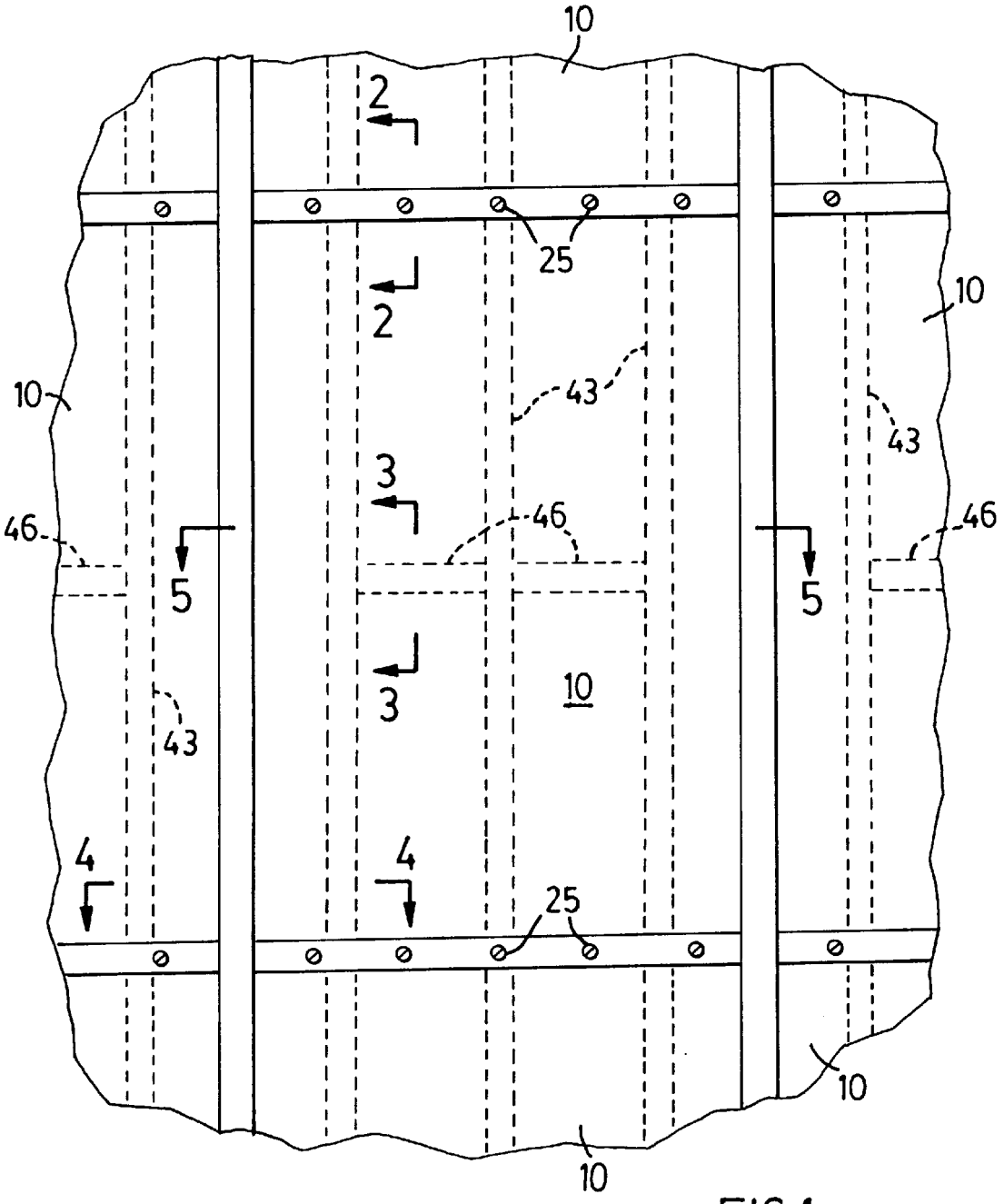
FIG. 1 is an elevational view of a panel mounting structure according to a preferred embodiment of the invention.

Referring to the drawings, 10 denotes generally each of a plurality of panels, with each panel 10 comprising a front portion 11 of rectangular form, two opposed rearwardly bent side portions 12 each of which has an inwardly bent edge portion 13, a rearwardly bent upper edge portion 14, and a rearwardly bent lower edge portion 15, the rearward edge portion of the upper portion 14 being bent to form a vertically extending upstanding flange 16, and the rearward edge portion of the lower portion 15 likewise being bent to form a vertically extending upstanding flange 17. Each panel 10 as hereinabove described is preferably formed from a unitary aluminum or steel sheet which is formed and bent to provide the front portion 11, the side portions 12 including the edge portions 13, the upper portion 14 including the flange 16, and the lower portion 15 including the flange 17, and it will be appreciated that this forming and bending are relatively simple and inexpensive operations.

A support denoted generally by the reference numeral 18 is provided for the mounting of the upper edge portion 14 of each panel 10 and the lower edge portion 15 of the upwardly adjacent panel 10, this support 18 which is preferably of extruded form such as extruded aluminum having a rear limb 19, an intermediate limb 20, and a front limb 21, with a first vertically extending downwardly open channel 22 being bounded by the rear limb 19 and the intermediate limb 20, and a second vertically extending downwardly open channel 23 being bounded by the intermediate limb 20 and the front limb 21. The flange 16 of one of the panels 10 is vertically movable by vertical movement of said one of the panels 10 into and out of the first channel 22, and the flange 17 of the upwardly adjacent panel 10 is likewise vertically movable by vertical movement of the upwardly adjacent panel 10 into and out of the second channel 23, the front limb 21 of the support 18 preferably having a lower edge portion 24 which is downwardly and forwardly inclined to facilitate entry of the flange 17 into the second channel 23. The upstanding flange 16 is detachably securable to the support 18 when disposed in the channel 22 preferably by screw members 25 disposed through the flange 16 and the rear limb 19 of the support 18 thereby to retain the flange 16 in the channel 22.

The spacing 26 between the upper edge portion 14 of said one of the panels 10 and the lower edge portion 15 of the upwardly adjacent panel 10 is at least as great as the vertical extent of the flange 17 of the upwardly adjacent panel 10 disposed within the channel 23 of the respective support 18 and is at least as great as the vertical extent of the flange 16 of the upwardly adjacent panel 10 disposed within the channel 22 of the respective support 18 thereby to permit the upwardly adjacent panel 10 to be sufficiently lowered for disengagement of the flanges 16 and 17 of the upwardly adjacent panel 10 from the channels 22 and 23 of the respective supports 18 without disturbing said one of the panels 10.

Figure 2:
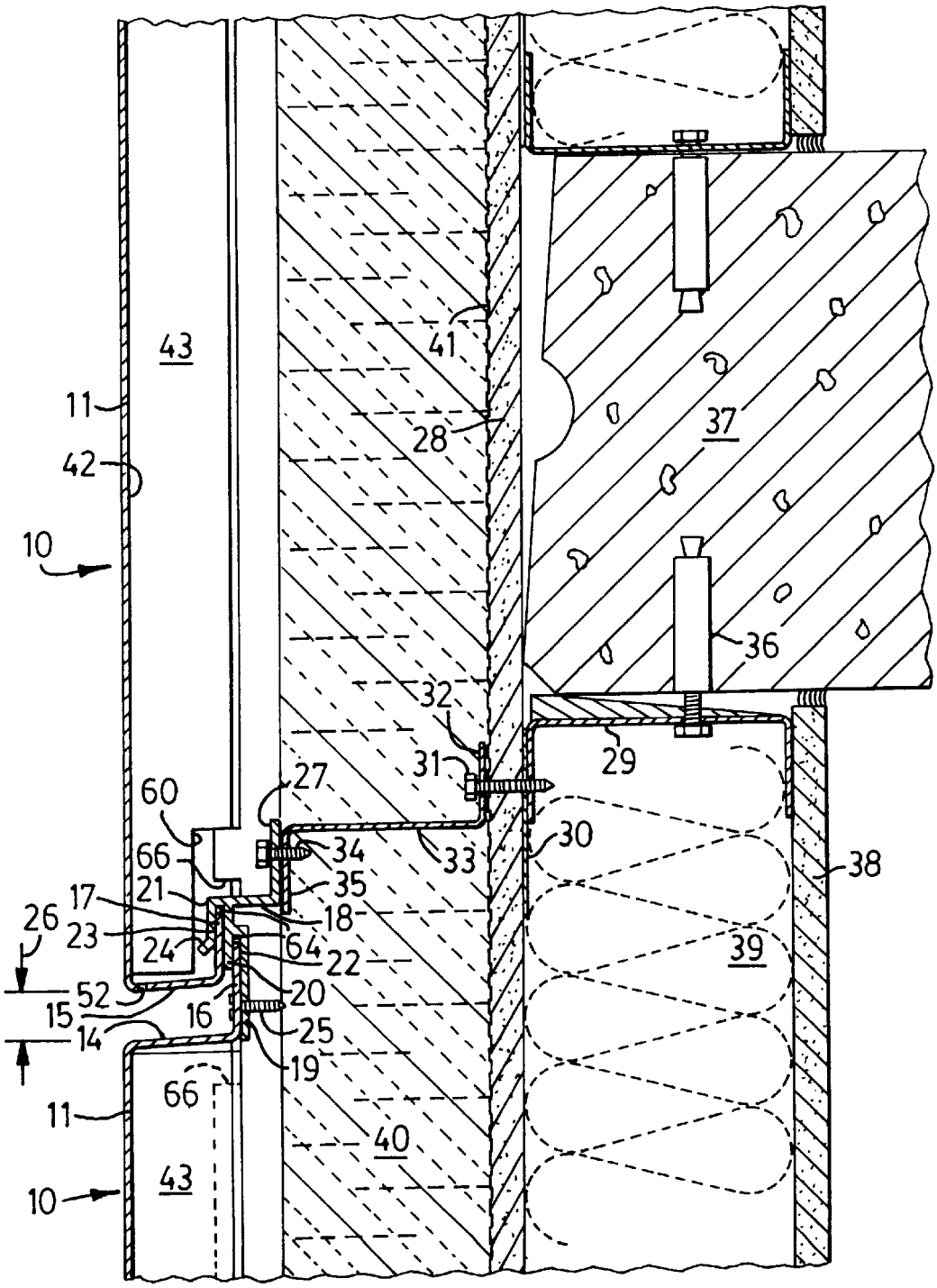
FIG. 2 is a sectioned view, on an enlarged scale, on the line 2—2 in FIG. 1.
Figure 3:
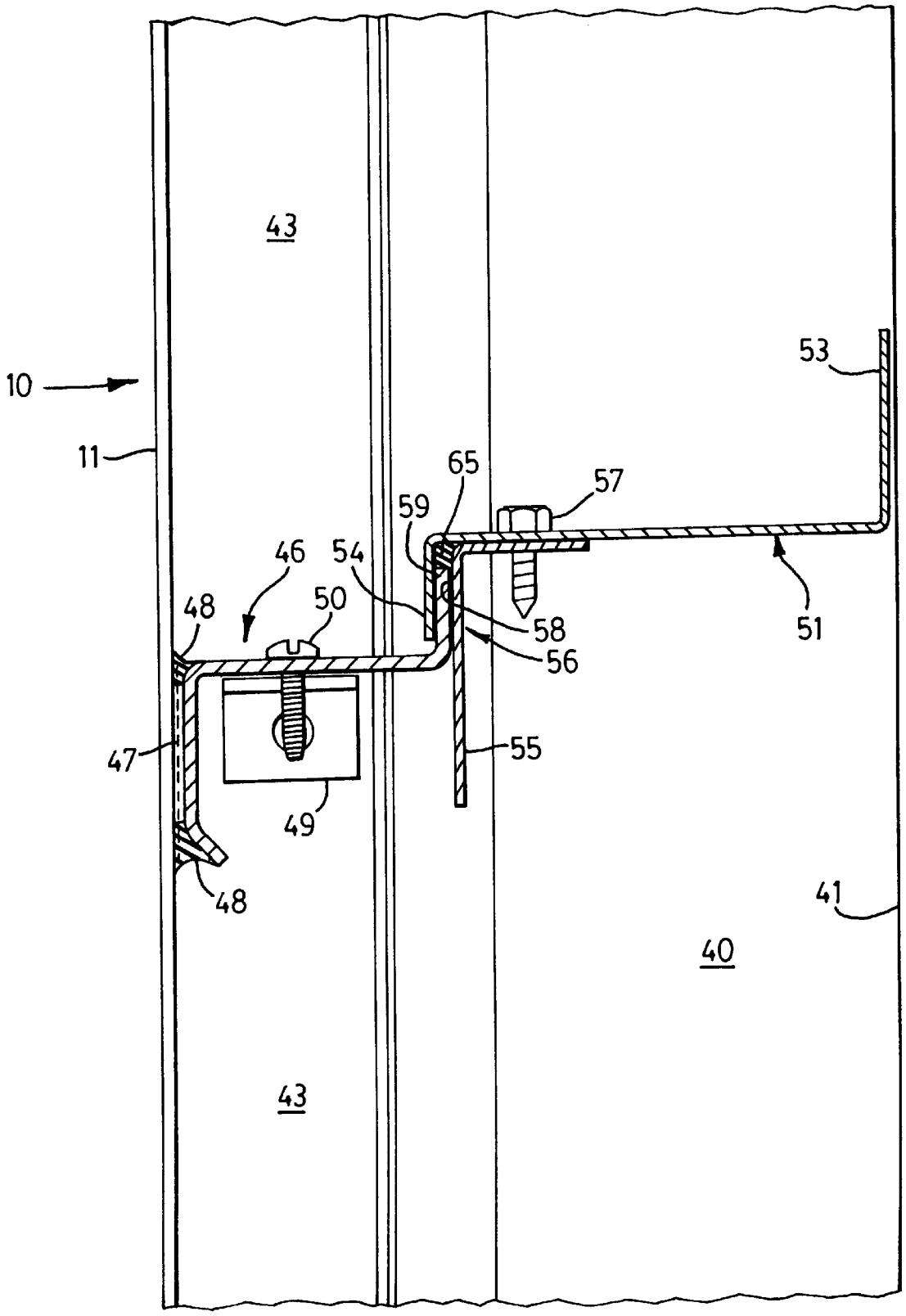
FIG. 3 is a sectioned view, also on an enlarged scale, on the line 3—3 in FIG. 1.

The support 18 also comprises an upstanding limb 27 by means of which the support 18 is mounted on a building structure. As shown in FIG. 2 in which the panels 10 constitute new cladding for an existing building structure, the exterior wall of the existing building structure has been removed and replaced by sheeting board 28, a U-shaped header 29 of the existing building structure being provided with a reinforcement plate 30 with screw members 31 securing one limb 32 of a Z-shaped bracket 33 through the sheeting board 28, the reinforcement plate 30 and the header 29, and with further screw members 34 securing the limb 27 of the support 18 to the other limb 35 of the Z-shaped bracket 33. In the existing building structure the header 29 is secured by appropriate fasteners 36 to a concrete flooring slab 37 and an interior wall board 38 is mounted on the header 29 with insulation 39 of the existing building structure being, in most cases, removed and insulation 40 being installed in the space traversed by the bracket 33 between the sheeting board 28 and the support 18 with an air/vapour barrier membrane 41 between the sheeting board 28 and this insulation 40.

The front portion 11 of each panel 10 has a rear face 42 on which at least one, and preferably a plurality of, vertically disposed, spaced stiffeners 43 each of which is of Z-shape in transverse cross-section is mounted by double sided adhesive tape 44, a vertically extending bead of silicone sealant 45 being disposed along each side of the adhesive tape 44. At least one intermediate member 46 of Z-shape in transverse cross-section is secured to the rear face 42 of the front portion 11 of each panel 10 by double sided adhesive tape 47 with a vertically extending bead of silicone sealant 48 along each side of the adhesive tape 47. Preferably there is a plurality of the intermediate members 46 with each member 46 extending between two adjacent stiffeners 43 and being supported thereby by angle brackets 49 secured to the stiffeners 43 and to the intermediate member 46 by screw members 50. An intermediate support comprising a bracket 51 of Z-shape in transverse cross-section is mounted to the existing building structure by, for example, screw members (not shown) disposed through a limb 53 of the bracket 51, the other limb 54 of which defines with a limb 55 of an angle member 56 secured to the bracket 51 by screw members 57 a vertically extending downwardly open channel 58 into and out of which a limb 59 of the intermediate member 46 constituting a vertically extending upstanding flange which is spaced rearwardly of the rear face 42 of the front portion 11 of the panel 10 is vertically movable by vertical movement of the panel 10.

A notch 60 is provided in the lower end of each stiffener 43 to accommodate the support 18 and to permit lowering of the associated panel 10 during disengagement of the upstanding flange 17 of the lower edge portion 15 of the panel 10 from the support 18.

Figure 4:
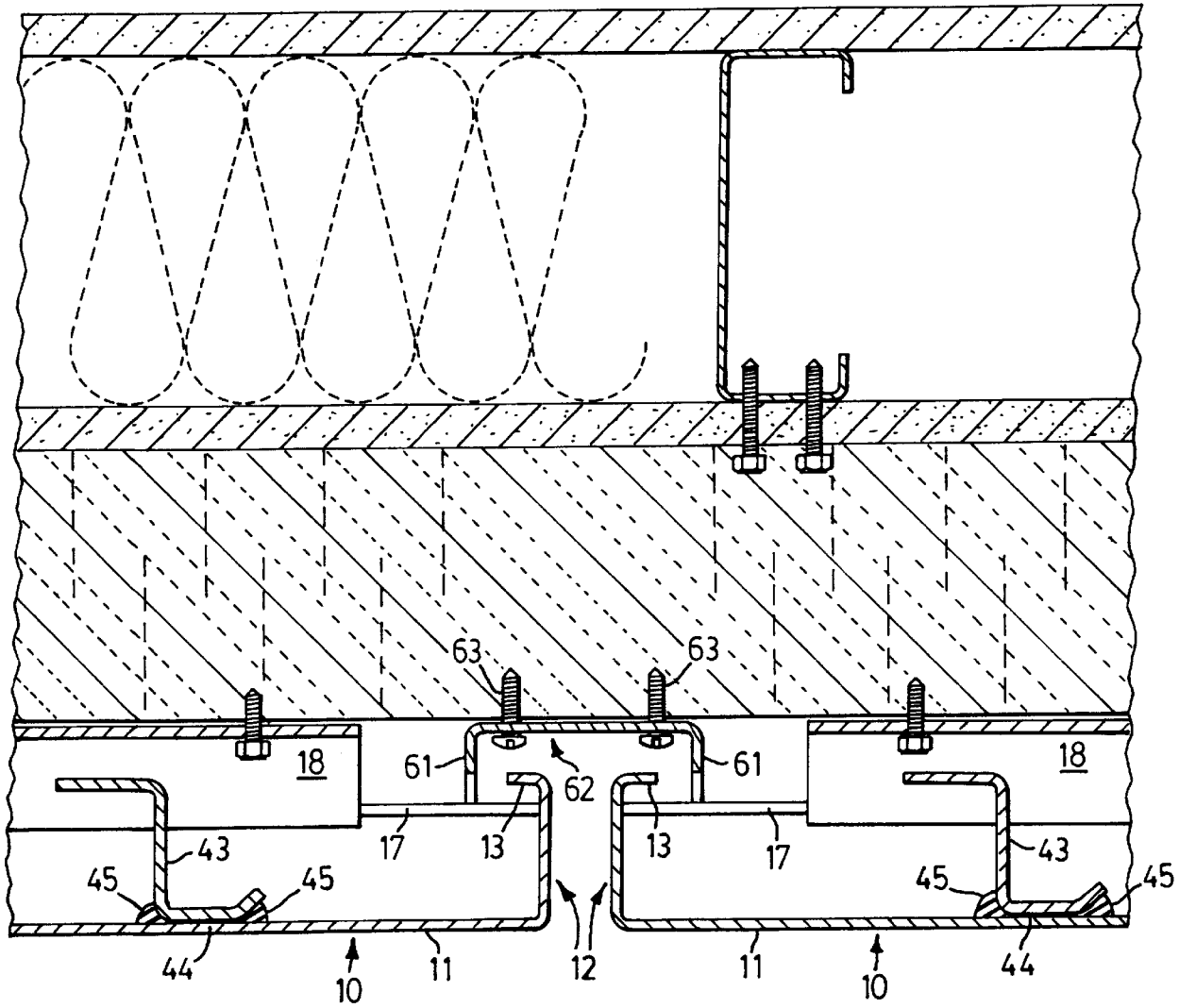
FIG. 4 is a sectioned view, on the same enlarged scale as FIG. 2, on the line 4—4 in FIG. 1.
Figure 5:
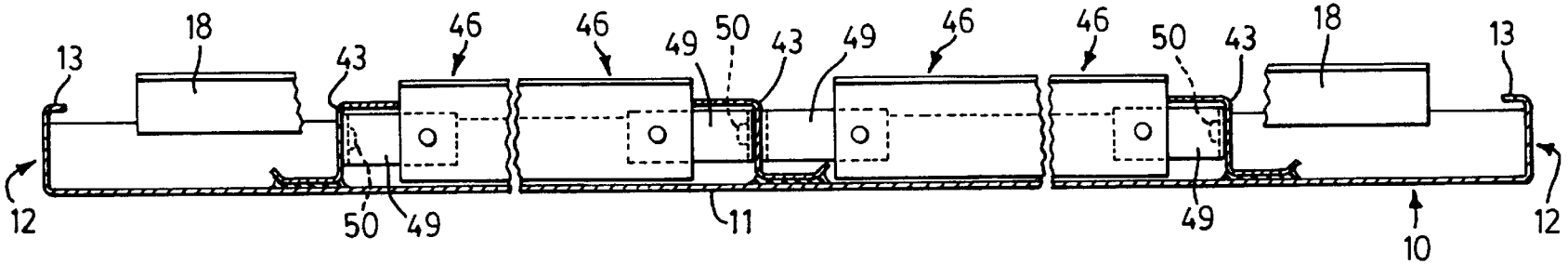
FIG. 5 is a sectioned view, on a reduced scale relative to FIGS. 2, 3 and 4, on the line 5—5 in FIG. 1.
Figure 6:
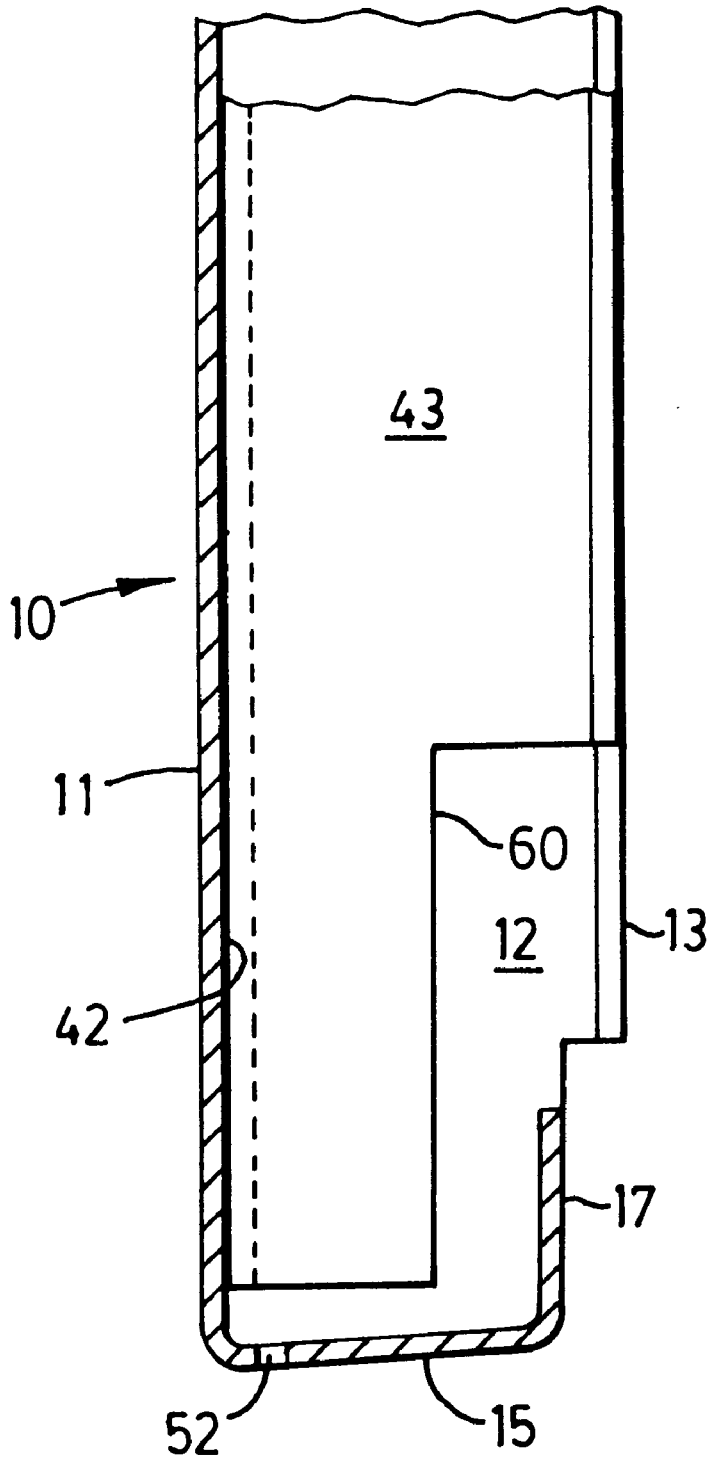
FIG. 6 is a sectioned view, on a further enlarged scale, of a portion of the structure shown in FIG. 2.

As shown in FIG. 4, the adjacent side portions 12 including the associated inwardly bent edge portions 13 of horizontally adjacent panels 10 are operatively disposed between the limbs 61 of a vertically extending U-shaped gutter 62 which is secured by screw members 63 to the limb 35 of the bracket 33, the limbs 61 of the gutter 62 being notched as shown by the reference numeral 66 at each support 18 to accommodate the upstanding flanges 16 and 17 of the vertically adjacent panels 10.

Preferably silicone sealant 64 is disposed at least within the end portions of the channels 22, 23 to seal the flanges 16, 17, respectively, therein, and likewise silicone sealant 65 is preferably disposed within the channel 58 to seal the limb 59 therein.

If one of the panels 10 becomes damaged or otherwise requires to be replaced, this panel 10 can readily and easily be removed by removing the screw members 25 by which the upstanding flange 16 of the upper edge portion 14 of the panel 10 is secured to the rear limb 19 of the respective support 18. This permits the panel 10 to be lowered with resultant disengagement of the upstanding flange 16 of the upper edge portion 24 of the panel 10 from the first downwardly open channel 22 of the support 18 together with resultant disengagement of the upstanding flange 17 of the lower edge portion 15 of the panel 10 from the second downwardly open channel 23 of the appropriate support 18 and disengagement of the limb 59 of the intermediate member 46 from the channel 58 of the bracket 51. The panel 10 is then removed, this removal of the panel 10 being by forwardly moving the lower edge portion 15 of the panel 10 thereby to tilt the panel 10 and then removing the upper edge portion 14 of the panel 10 if such tilting of the panel 10 is necessary for the upstanding flange 16 of the upper edge portion 14 of the panel 10 to clear the lower edge portion 15 of the upwardly adjacent panel 10. To mount a replacement panel 10, the above-described operations are performed in reverse, and in the reverse sequence, removal and mounting of the panels 10 thus being achieved without vertical movement or otherwise disturbing the mounting of the vertically adjacent panels 10.

The lower edge portion 15 of each panel 10 is in the form of a trough with at least one and preferably a plurality of weep holes 52 being provided in this trough so that any moisture may drain out through these weep holes 52, the lower edge portion 15 in which the weep holes 52 are formed preferably slightly sloping downwardly in the forward direction to facilitate such drainage of moisture through the weep holes 52. The upper edge portion 14 of each panel 10 is preferably likewise slightly sloped downwardly in the forward direction so that rainwater or other moisture may drain forwardly and down the front portion 11 of the panel 10.

What is claimed is:

1. A panel mounting structure comprising a plurality of vertically adjacent panels each having an upper edge portion and a lower edge portion, and supports each of which is for mounting the upper edge portion of one of the panels and the lower edge portion of the upwardly adjacent panel, with each support having a first vertically extending downwardly open channel and a second vertically extending downwardly open channel, said upper edge portion of said one of the panels having a vertically extending upstanding flange which is vertically movable by vertical movement of said one of the panels into and out of the first downwardly open channel of the support without vertical movement of the upwardly adjacent panel, the upstanding flange of the upper edge portion of said one of the panels being detachably securable to the support when disposed in the first downwardly open channel to retain therein the upstanding flange of the upper edge portion of said one of the panels, said lower edge portion of the upwardly adjacent panel having a vertically extending upstanding flange which is vertically movable by vertical movement of the upwardly adjacent panel into and out of the second downwardly open channel of the support without vertical movement of said one of the panels, and the spacing between the upper edge portion of each panel and the lower edge portion of the upwardly adjacent panel being at least as great as the vertical extent of the upstanding flange of the lower edge portion of the upwardly adjacent panel disposed within the second downwardly open channel of the respective support, and being at least as great as the vertical extent of the upstanding flange of the upper edge portion of the upwardly adjacent panel disposed within the first downwardly open channel of the respective support, thereby to provide said mounting on the respective support of the upper edge portion of said one of the panels and the lower edge portion of the upwardly adjacent panel, with the upper edge portion and the lower edge portion of each panel being so mountable on and dismountable from the respective supports without disturbing the mounting of the vertically adjacent panels.

2. A panel mounting structure according to claim 1, wherein the first downwardly open channel of the support is bounded by a rear limb and an intermediate limb, and the second downwardly open channel of the support is bounded by the intermediate limb and a front limb, a plurality of screw members being disposed through the upstanding flange of the upper edge portion of said one of the panels and the rear limb of the support to provide said detachable securement of the upstanding flange of the upper edge portion of said one of the panels to the support.

3. A panel mounting structure according to claim 1, wherein the first downwardly open channel of the support is bounded by a rear limb and an intermediate limb, and the second downwardly open channel of the support is bounded by the intermediate limb and a front limb, the front limb of the support having a lower edge portion which is downwardly and forwardly inclined.

4. A panel mounting structure according to claim 1, wherein silicone sealant is disposed within the first downwardly open channel of the support.

5. A panel mounting structure according to claim 1, wherein silicone sealant is disposed within the second downwardly open channel of the support.

6. A panel mounting structure according to claim 1, wherein the lower edge portion of each panel comprises a trough, with at least one weep hole being provided in the trough.

7. A panel mounting structure according to claim 1, wherein each panel comprises a front portion having a rear face, and at least one vertically disposed stiffener of Z-shape in transverse cross-section is secured to the rear face of the front portion of the panel.

8. A panel mounting structure according to claim 1, wherein each panel comprises a front portion having a rear face, and at least one intermediate member is secured to the rear face of the front portion of the panel, with the intermediate member comprising a vertically extending upstanding flange spaced rearwardly of the rear face of the front portion of the panel, an intermediate support being provided with the intermediate support having a vertically extending downwardly open channel into and out of which the vertically extending upstanding flange of the intermediate member is vertically movable by vertical movement of the panel.

9. A panel mounting structure according to claim 8, wherein vertically disposed stiffeners are secured to the rear face of the front portion of each panel, angle brackets being secured to the stiffeners and to said at least one intermediate member for supporting said at least one intermediate member by the stiffeners.

* * * * *